US009932191B2

(12) United States Patent
Oshiro

(10) Patent No.: US 9,932,191 B2
(45) Date of Patent: Apr. 3, 2018

(54) SHEET POST-PROCESSING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshiaki Oshiro, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 9 days.

(21) Appl. No.: 15/096,342

(22) Filed: Apr. 12, 2016

(65) Prior Publication Data

US 2017/0291785 A1 Oct. 12, 2017

(51) Int. Cl.

| | |
|---|---|
| ***B65H 29/68*** | (2006.01) |
| ***B65H 29/12*** | (2006.01) |
| ***B65H 43/00*** | (2006.01) |
| ***B65H 29/22*** | (2006.01) |

(52) U.S. Cl.

CPC ..... *B65H 29/125* (2013.01); *B65H 29/22* (2013.01); *B65H 29/68* (2013.01); *B65H 43/00* (2013.01); *B65H 2801/27* (2013.01)

(58) Field of Classification Search

CPC ..... B65H 29/68; B65H 29/125

See application file for complete search history.

(56) References Cited

U.S. PATENT DOCUMENTS

| | | | | |
|---|---|---|---|---|
| 4,121,187 | A * | 10/1978 | Mahieu | H01H 85/06 337/171 |
| 4,693,461 | A * | 9/1987 | Takahashi | G03B 27/6264 271/176 |
| 4,995,859 | A * | 2/1991 | Totani | B65H 29/68 271/182 |
| 5,215,300 | A * | 6/1993 | Hiroi | B65H 9/14 271/176 |
| 7,172,187 | B2 | 2/2007 | Terao et al. | |
| 7,509,066 | B2 * | 3/2009 | Koshida | G03G 15/657 399/16 |
| 8,408,544 | B2 * | 4/2013 | Reinke | H04N 1/00631 271/202 |
| 8,622,390 | B2 * | 1/2014 | Soga | G03G 15/6552 271/176 |
| 8,844,927 | B2 | 9/2014 | Hazu et al. | |
| 8,991,817 | B1 * | 3/2015 | Terao | B65H 29/70 271/188 |
| 9,505,579 | B2 * | 11/2016 | Ishikawa | B65H 29/125 |
| 2015/0246560 | A1 * | 9/2015 | Nakamura | B65H 29/68 271/182 |

* cited by examiner

*Primary Examiner* — Luis A Gonzalez

(74) *Attorney, Agent, or Firm* — Amin, Turocy & Watson LLP

(57) ABSTRACT

There is provided a sheet post-processing device that has a first tray, outlet rollers, and a control section. The first tray holds sheets for post-processing with respect to the sheets supplied from an image forming device. The outlet rollers discharge the sheet to the first tray. The control section controls a rotational speed of the outlet rollers to be decelerated after a leading end portion of the sheet passes through the outlet rollers and before the leading end portion of the sheet comes into contact with the first tray.

3 Claims, 13 Drawing Sheets

[Fig. 1]
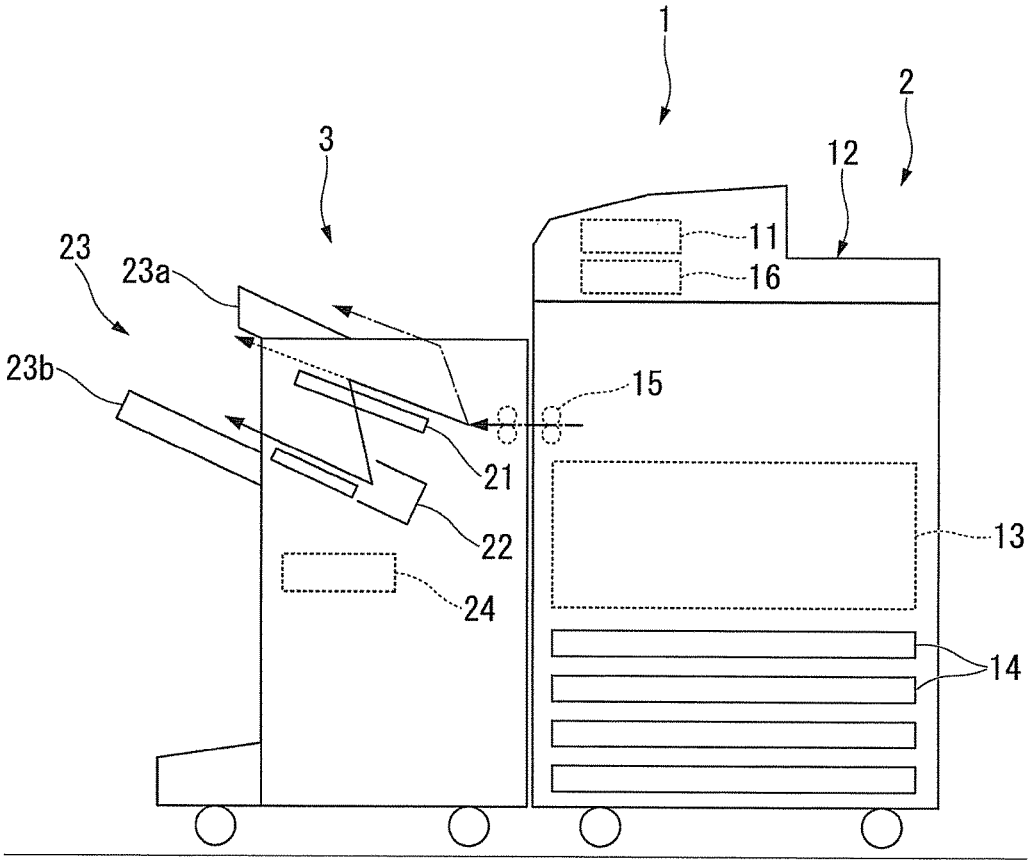

[Fig. 2]
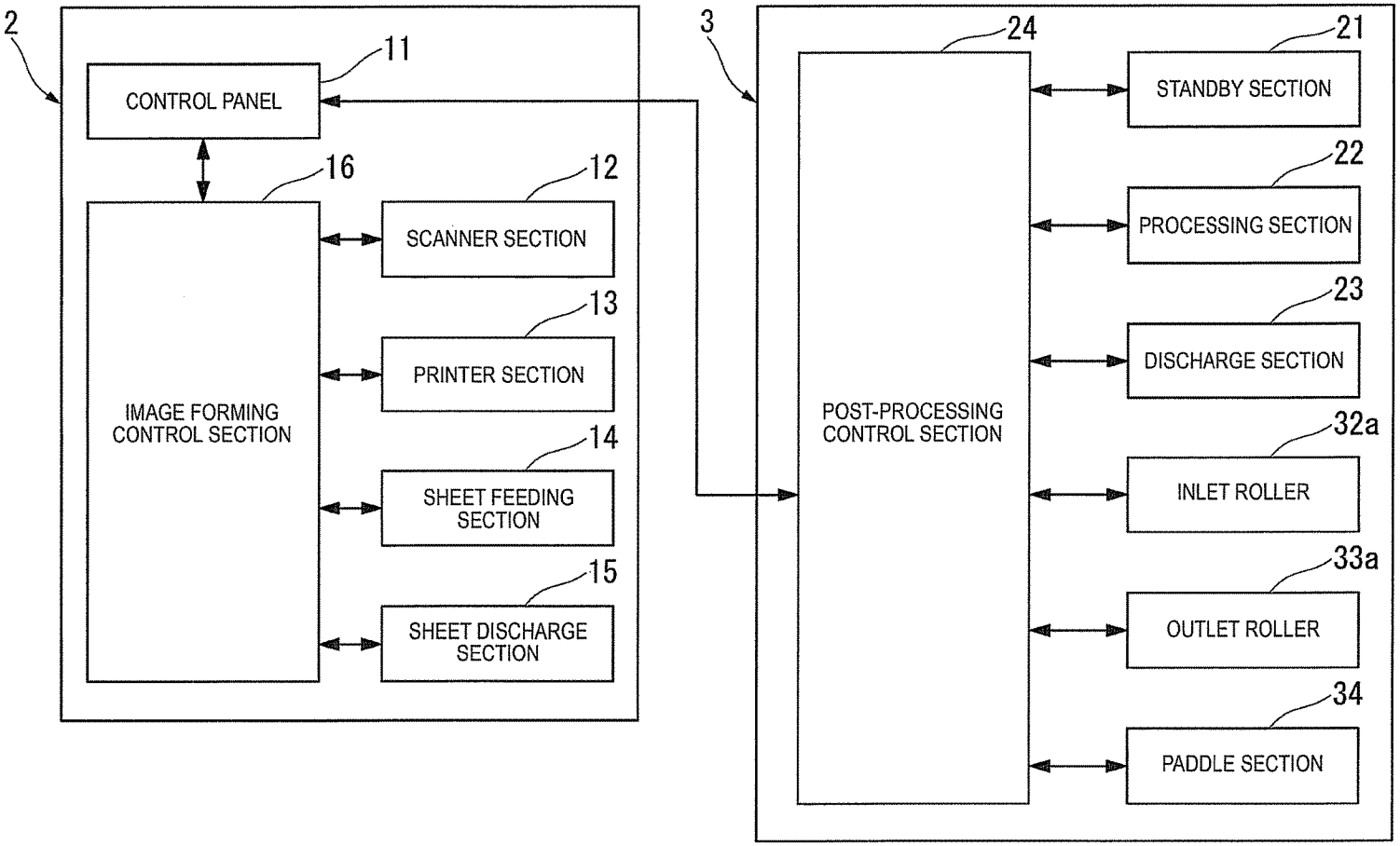

[Fig. 3]
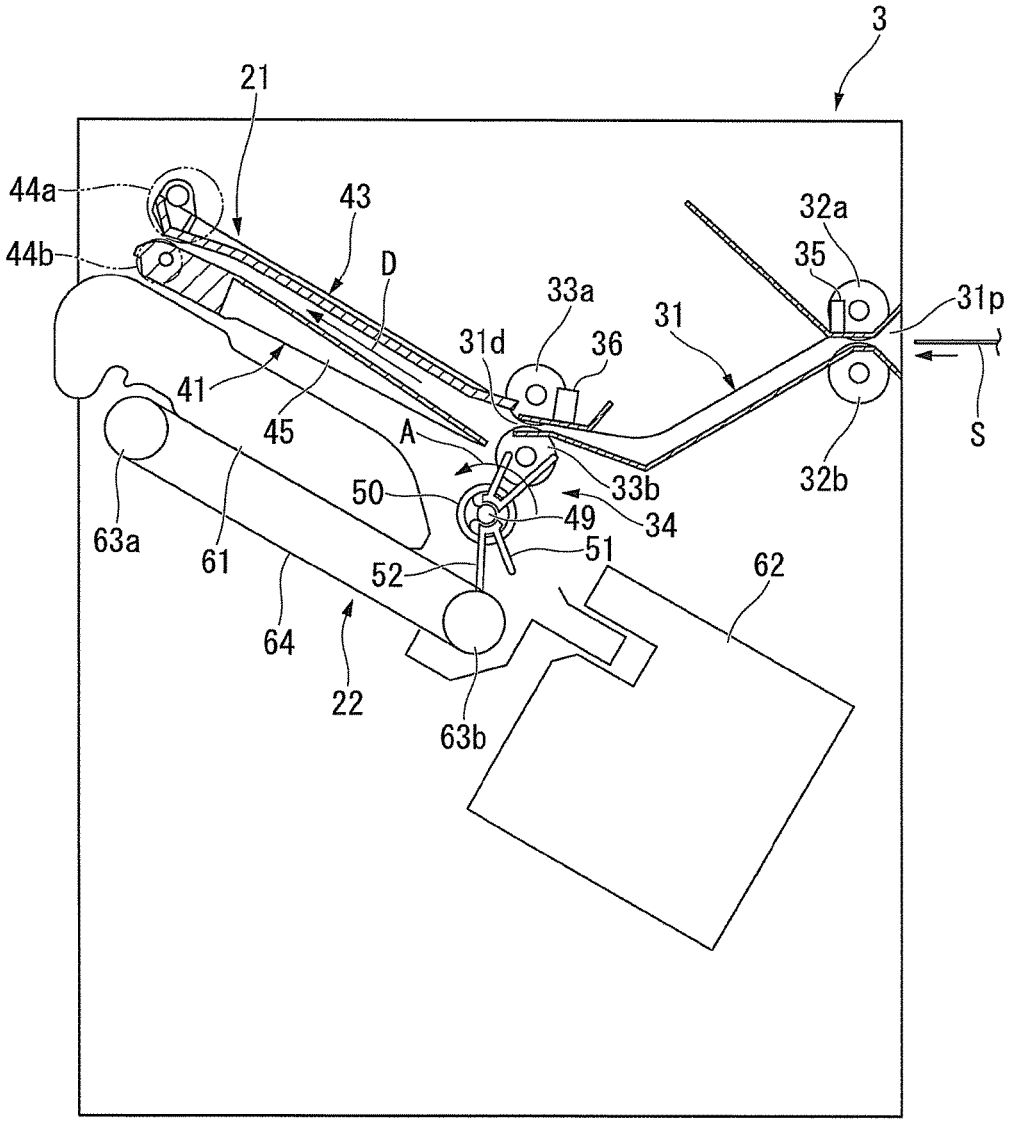

[Fig. 4]
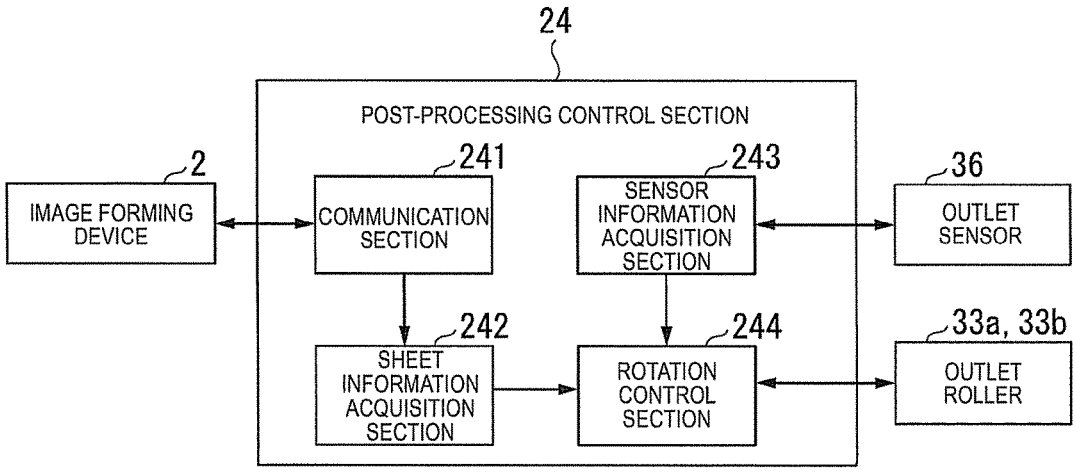

[Fig. 5]
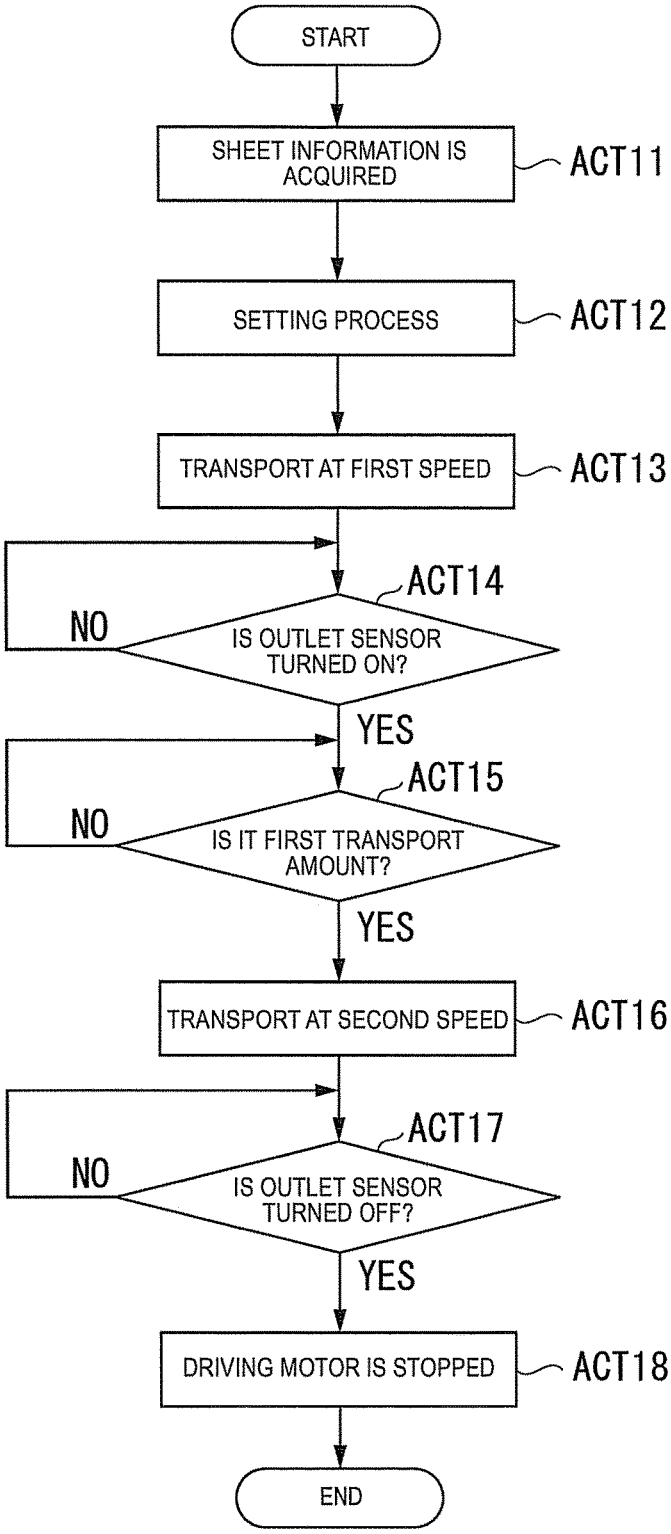

[Fig. 6]
RELATED ART
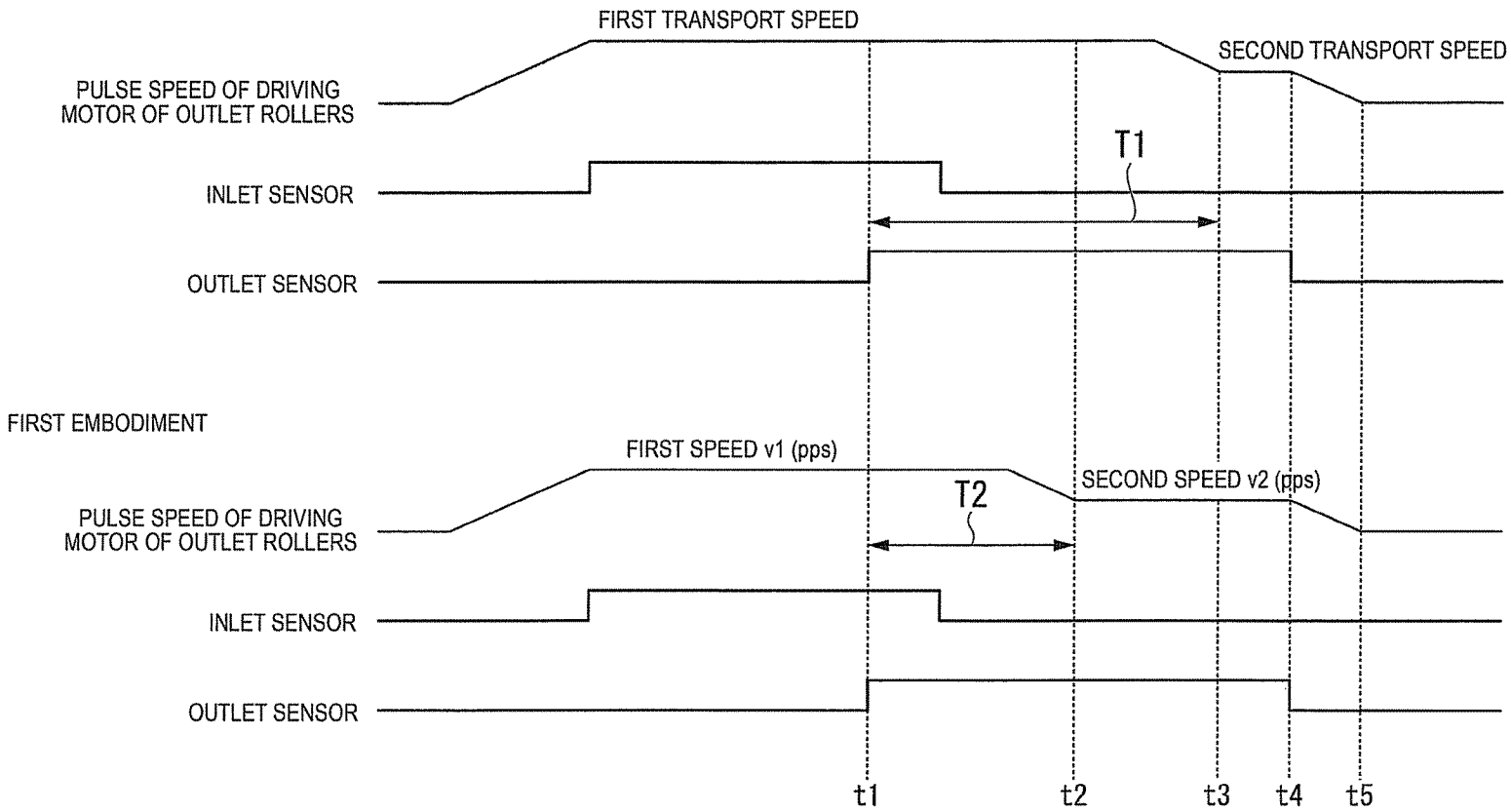

[Fig. 7]
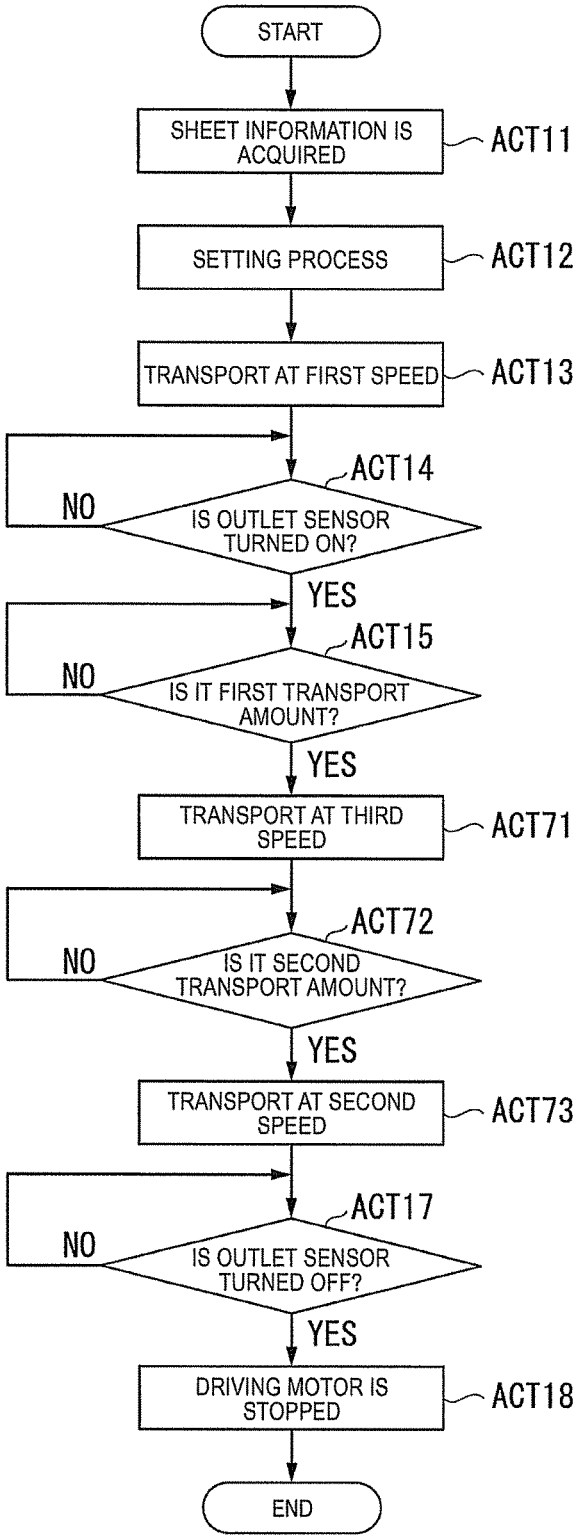

[Fig. 8]
MODIFICATION EXAMPLE OF FIRST EMBODIMENT
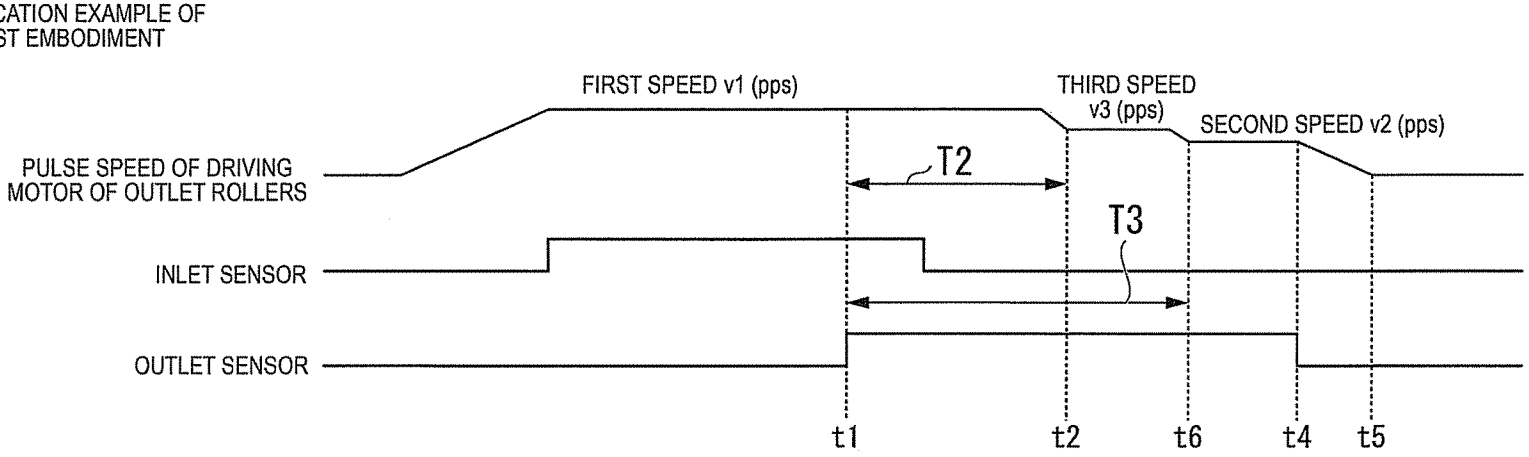

[Fig. 9]
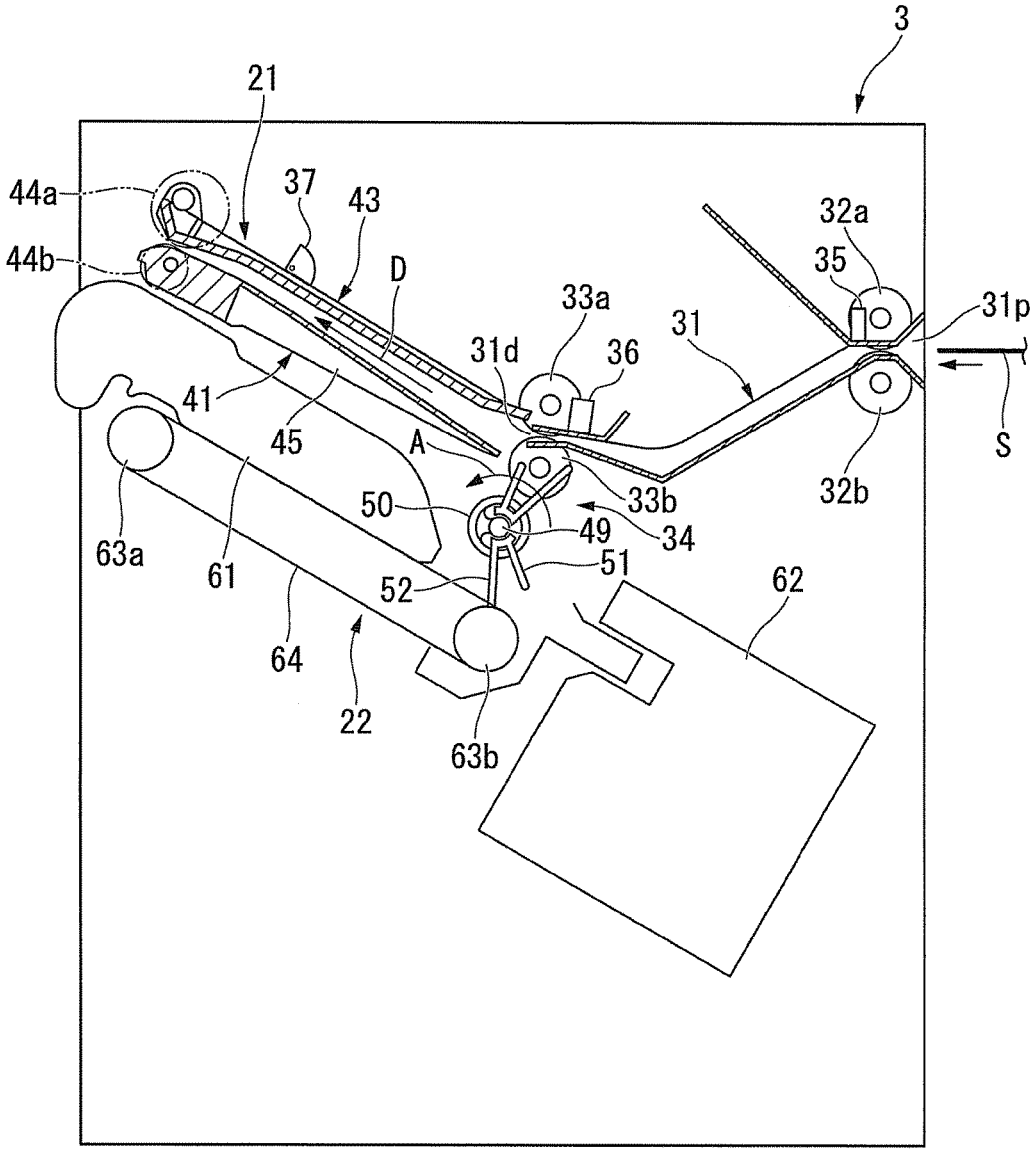

[Fig. 10]
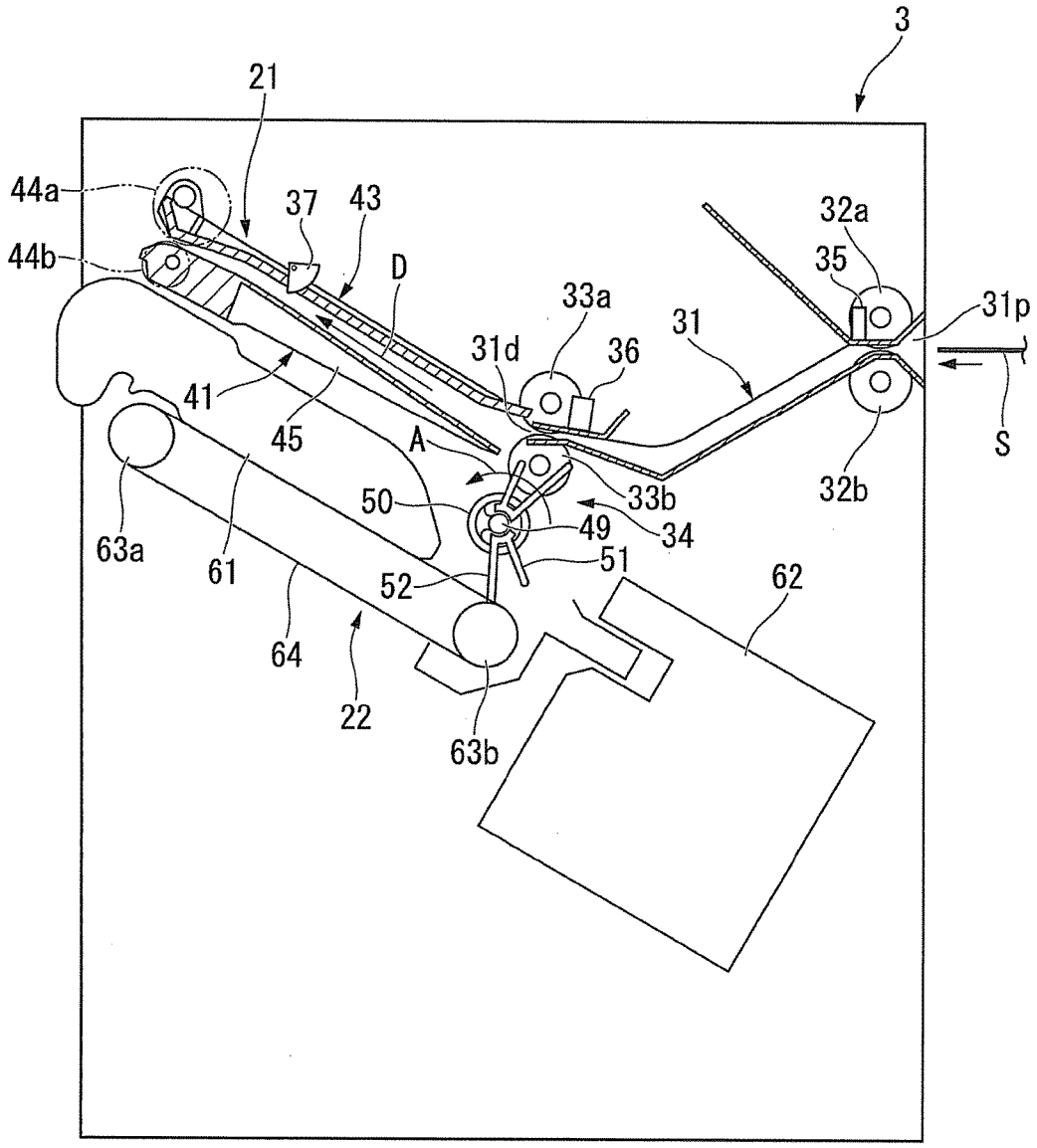

[Fig. 11]
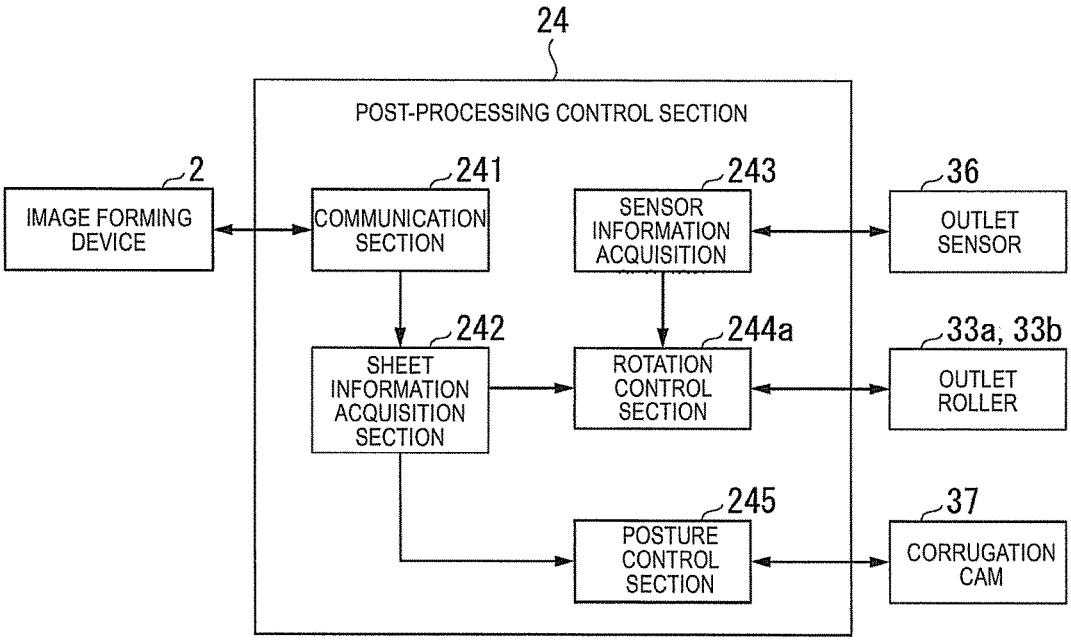

[Fig. 12]
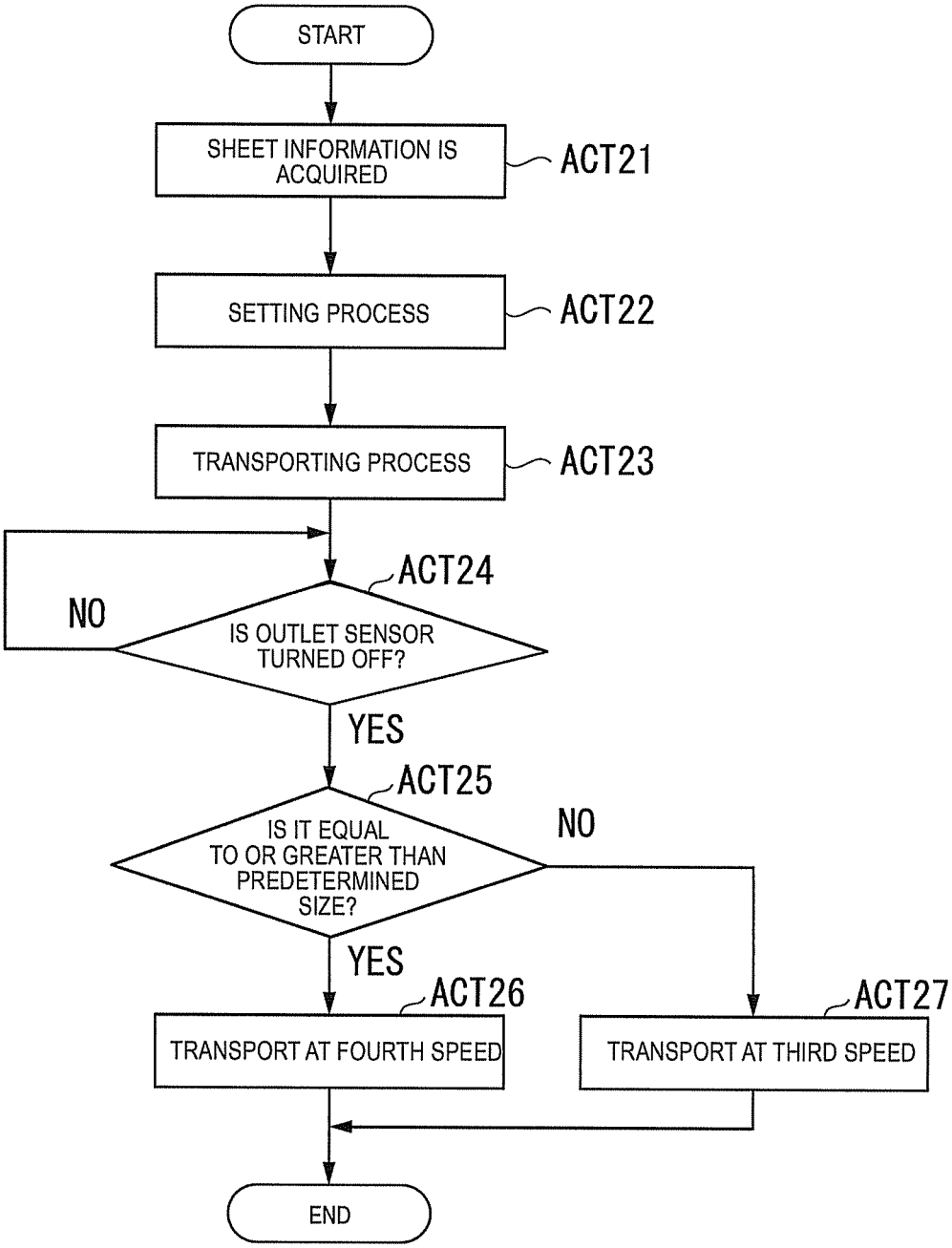

[Fig. 13]
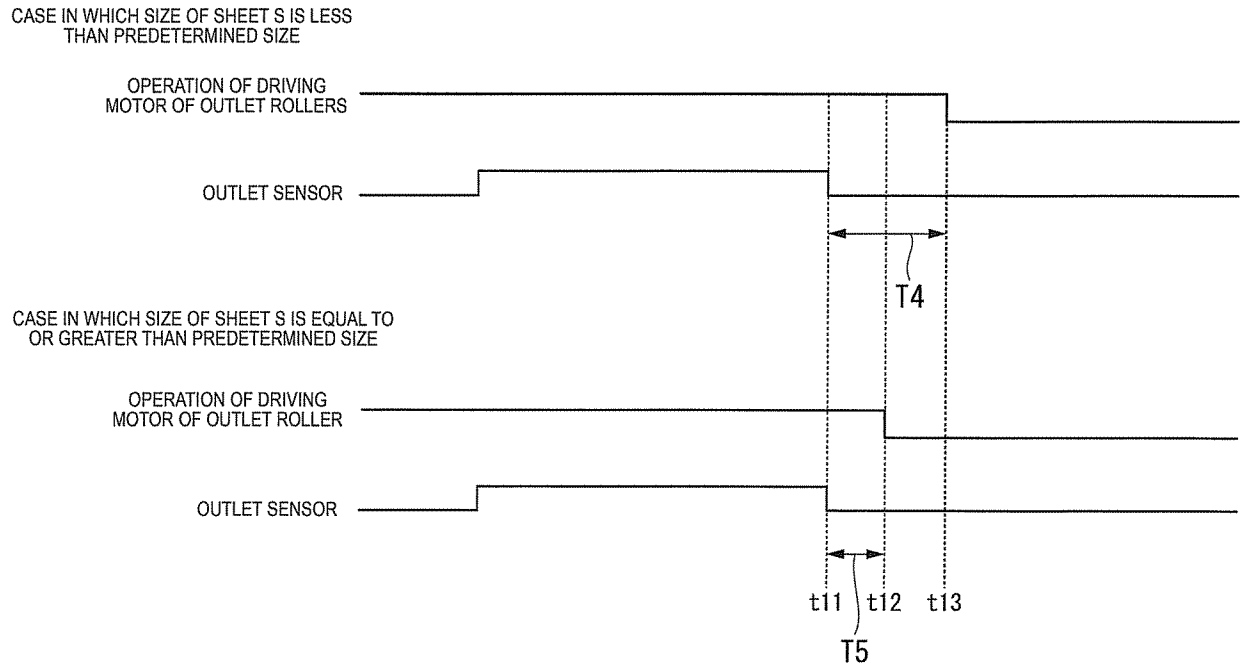

SHEET POST-PROCESSING DEVICE

FIELD

Embodiments described herein relate generally to a sheet post-processing device.

BACKGROUND

A Multiple Function Peripheral (MFP) of the related art includes a sheet post-processing device that post-processes sheets transported from an image forming device. The sheet post-processing device includes a processing tray that holds the sheets for post-processing of the sheets, inlet rollers through which the sheet is input from the image forming device, and outlet rollers that output the sheet input from the inlet rollers to the processing tray. The sheet post-processing device controls a transport speed of the sheet when discharging the sheet from the outlet rollers to the processing tray. The control of the transport speed is performed at timing near the exit of a trailing end of the sheet from the outlet rollers after a leading end of the sheet comes into contact with the processing tray. In addition, in the transport speed of the sheet, there are a first transport speed that is a speed for transporting the sheet and a second transport speed (first transport speed>the second transport speed) that is a speed suitable for discharging the sheet to the processing tray. The sheet post-processing device performs control to decelerate the transport speed of the sheet from the first transport speed to the second transport speed in the vicinity of the exit of the trailing end of the sheet from the outlet rollers. However, in the control of the transport speed of the sheet in such a sheet post-processing device, the speed (=first transport speed) of the sheet in the middle of discharging the sheet from the outlet rollers to the processing tray is large and the sheet may be buckled and the like. Thus, positions of the sheets discharged on the processing tray may be varied.

DESCRIPTION OF THE DRAWINGS

FIG. 1 is a view illustrating an entire configuration example of an image forming system of an embodiment.

FIG. 2 is a block diagram illustrating a functional configuration example of the image forming system.

FIG. 3 is a view schematically illustrating a configuration of a sheet post-processing device of a first embodiment.

FIG. 4 is a block diagram illustrating functional blocks related to control of a transport speed of a sheet in a post-processing control section.

FIG. 5 is a flowchart illustrating a control operation example of the transport speed of the sheet in the post-processing control section of the sheet post-processing device.

FIG. 6 is a diagram comparing a control operation of the transport speed of the sheet in the post-processing control section to a control operation in the related art.

FIG. 7 is a flowchart illustrating an operation example for controlling the transport speed of the sheet in a multistage manner in the post-processing control section of the sheet post-processing device.

FIG. 8 is a diagram describing the control operation of the transport speed of the sheet in the multistage manner in the post-processing control section.

FIG. 9 is a view schematically describing a configuration of the sheet post-processing device in a second embodiment.

FIG. 10 is a view illustrating a state in which a corrugation cam is functioning.

FIG. 11 is a block diagram illustrating functional blocks related to the control of the transport of the sheet discharged to a standby tray in the post-processing control section.

FIG. 12 is a flowchart illustrating an operation example of control of a transport amount of the sheet on the standby tray in the post-processing control section of the second embodiment.

FIG. 13 is a timing chart describing a control operation of the transport amount of the sheet in the post-processing control section of the second embodiment.

DETAILED DESCRIPTION

A sheet post-processing device of an embodiment has a first tray, outlet rollers, and a control section. The first tray holds sheets for post-processing with respect to the sheets supplied from an image forming device. The outlet rollers discharge the sheet to the first tray. The control section controls a rotational speed of the outlet rollers to be decelerated after a leading end portion of the sheet passes through the outlet rollers and before the leading end portion of the sheet comes into contact with the first tray.

Hereinafter, an image forming system including the image forming device and the sheet post-processing device of the embodiment will be described with reference to the drawings.

Common Embodiment of First and Second Embodiments

FIG. 1 is a view illustrating an entire configuration example of an image forming system 1 of an embodiment. FIG. 2 is a block diagram illustrating a functional configuration example of the image forming system 1 illustrated in FIG. 1. The image forming system 1 includes an image forming device 2 and a sheet post-processing device 3. The image forming device 2 forms an image on a sheet-shaped medium (hereinafter, referred to as "sheet") such as paper. The sheet post-processing device 3 post-processes the sheets transported from the image forming device 2.

The image forming device 2 includes a control panel 11, a scanner 12, a printer 13, a sheet feeding section 14, a sheet discharge section 15, and an image forming control section 16. The control panel 11 includes various keys for receiving operations of a user. For example, the control panel 11 receives an input related to types of post-processing of the sheets. The control panel 11 transmits information (including information related to types of the sheets) related to the types of input post-processing to the sheet post-processing device 3.

The scanner 12 includes a reading section for reading image information of a copy object. The scanner 12 transmits the read image information to the printer 13. The printer 13 forms an output image (hereinafter, referred to as "toner image") by developer such as toner based on image information transmitted from the scanner 12 or an external device. The printer 13 transfers the toner image on a surface of the sheet. The printer 13 fixes the toner image onto the sheet by applying heat and pressure to the toner image that is transferred to the sheet. The sheet feeding section 14 supplies the sheets to the printer 13 one by one in accordance with timing when the printer 13 forms the toner image. The sheet discharge section 15 transports the sheet discharged from the printer 13 to the sheet post-processing device 3.

The image forming control section 16 controls an entire operation of the image forming device 2. That is, the image forming control section 16 controls the control panel 11, the scanner 12, the printer 13, the sheet feeding section 14, and the sheet discharge section 15. The image forming control section 16 is formed of a control circuit including a CPU, a ROM, and a RAM.

Next, the sheet post-processing device 3 will be described.

First, an entire configuration of the sheet post-processing device 3 will be described. As illustrated in FIG. 1, the sheet post-processing device 3 is disposed adjacent to the image forming device 2. The sheet post-processing device 3 executes post-processing that is designated through the control panel 11 on the sheets transported from the image forming device 2. For example, post-processing is stapling or sorting. The sheet post-processing device 3 includes a standby section 21, a processing section 22, a discharge section 23, and the post-processing control section 24.

The standby section 21 causes the sheet S (see FIG. 3) transported from the image forming device 2 to temporarily stay (buffer). For example, the standby section 21 causes a following plurality of sheets S to be on standby during post-processing of a preceding sheet S performed by the processing section 22. The standby section 21 is provided above the processing section 22. The standby section 21 drops the staying sheet S to the processing section 22, for example, by retreating from above the processing section 22 if the sheet of the processing section 22 is discharged to the discharge section 23.

The processing section 22 performs post-processing in the sheets S. For example, the processing section 22 aligns the plurality of sheets S. The processing section 22 performs stapling in the plurality of aligned sheets S. Therefore, the plurality of sheets S are bound together. The processing section 22 discharges the post-processed sheets S to the discharge section 23. The discharge section 23 includes a fixed tray 23*a* and a movable tray 23*b*. The fixed tray 23*a* is provided in an upper portion of the sheet post-processing device 3. The movable tray 23*b* is provided in a side portion of the sheet post-processing device 3. The sorting sheets S are discharged to the fixed tray 23*a* and the movable tray 23*b*.

The post-processing control section 24 controls an entire operation of the sheet post-processing device 3. That is, the post-processing control section 24 controls the standby section 21, the processing section 22, and the discharge section 23. In addition, as illustrated in FIG. 2, the post-processing control section 24 controls an inlet roller 32*a*, an outlet roller 33*a*, and a paddle section 34 described below. The post-processing control section 24 is formed of a control circuit including a CPU, a ROM, and a RAM.

First Embodiment

Next, a configuration of each section of the sheet post-processing device 3 in the first embodiment will be described. FIG. 3 is a view schematically illustrating a configuration of the sheet post-processing device 3 of the first embodiment. As illustrated in FIG. 3, the sheet post-processing device 3 has a transport path 31 of the sheet S, a pair of the inlet rollers 32*a* and 32*b*, a pair of the outlet rollers 33*a* and 33*b*, the standby section 21, the paddle section 34, and the processing section 22.

Moreover, in the present specification, "sheet transporting direction" refers to a transporting direction D (entering direction of the sheet S to the standby tray 41) of the sheet S with respect to the standby tray 41 of the standby section 21. In addition, in the present specification, "upstream side" and "downstream side" respectively refer to an upstream side and a downstream side in the sheet transporting direction D. In addition, in the present specification, "leading end portion" and "trailing end portion" respectively refer to "end portion on the downstream side" and "end portion of the upstream side" in the transporting direction D. Furthermore, in the present specification, a direction that is substantially parallel to an upper surface (transport surface) of the standby tray 41 and is substantially orthogonal to the sheet transporting direction D refers to a sheet width direction W.

The transport path 31 is provided on the inside of the sheet post-processing device 3. The transport path 31 has a sheet supply port 31*p* and a sheet discharge port 31*d*. The sheet supply port 31*p* faces the image forming device 2. The sheet S is supplied from the image forming device 2 to the sheet supply port 31*p*. On the other hand, the sheet discharge port 31*d* is positioned in the vicinity of the standby section 21. The sheet S passing through the transport path 31 is discharged from the sheet discharge port 31*d* onto the standby tray 41 of the standby section 21.

The inlet rollers 32*a* and 32*b* are provided in the vicinity of the sheet supply port 31*p*. The inlet rollers 32*a* and 32*b* transport the sheet S supplied to the sheet supply port 31*p* toward the downstream side of the transport path 31. For example, the inlet rollers 32*a* and 32*b* transport the sheet S supplied to the sheet supply port 31*p* to the outlet rollers 33*a* and 33*b*. An inlet sensor 35 is provided in the vicinity of the inlet roller 32*a* and detects the sheet S passing through the sheet supply port 31*p*. The inlet sensor 35 outputs a detection signal of a high level, for example, when detecting the sheet S and outputs a detection signal of a low level when not detecting the sheet S.

The outlet rollers 33*a* and 33*b* are provided in the vicinity of the sheet discharge port 31*d*. The outlet rollers 33*a* and 33*b* receive the sheet S transported by the inlet rollers 32*a* and 32*b*. The outlet rollers 33*a* and 33*b* transport the sheet S from the sheet discharge port 31*d* to the standby section 21. An outlet sensor 36 is provided in the vicinity of the outlet roller 33*a* and detects the sheet S passing through the sheet discharge port 31*d*. The outlet sensor 36 outputs a detection signal of a high level, for example, when detecting the sheet S and outputs a detection signal of a low level when not detecting the sheet S.

Next, the standby section 21 will be described. The standby section 21 has the standby tray (buffer tray) 41, a transport guide 43, and discharge rollers 44*a* and 44*b*. The standby tray 41 is an example of "second tray". A rear end portion of the standby tray 41 is positioned in the vicinity of the outlet rollers 33*a* and 33*b*. The standby tray 41 overlaps the plurality of sheets S to be on standby when post-processing is performed by the processing section 22. The standby tray 41 has a bottom wall 45 supporting the sheet S from below. The bottom wall 45 is configured of, for example, two plate-shaped members in parallel to the sheet transporting direction. The two plate-shaped members hold the sheet S on plate surfaces thereof. The two plate-shaped members drop the held sheet S on a processing tray 61 by retreating to be divided in the rightward and leftward direction perpendicular to the sheet transporting direction.

The paddle section 34 is provided between the standby tray 41 and the processing tray 61. The paddle section 34 presses the sheet S toward the processing tray 61 by rotating if the sheet S is transported from the standby tray 41 to the processing tray 61. Furthermore, the paddle section 34 transports the sheet S dropped on the processing tray 61 to a stapler 62 described below. The paddle section 34 has a rotary shaft 49, a rotary body 50, a plurality of first paddles 51, and a plurality of second paddles 52.

Next, the processing section 22 will be described. The processing section 22 has the processing tray 61, the stapler 62, transport rollers 63*a* and 63*b*, and a transport belt 64. The processing tray 61 is an example of "first tray". The processing tray 61 is provided below the standby tray 41. The plurality of sheets S transported to the processing tray 61 are aligned in the sheet width direction W and the sheet transporting direction D by an alignment plate and the like. The stapler 62 is provided in an end portion of the processing tray 61. The stapler 62 performs stapling (stitching) in a bundle of a predetermined number of the sheets S positioned on the processing tray 61.

The transport rollers 63*a* and 63*b* are disposed at predetermined intervals in the sheet transporting direction D. The transport belt 64 is stretched between the transport rollers 63*a* and 63*b*. The transport belt 64 is rotated in synchronization with the transport rollers 63*a* and 63*b*. The transport belt 64 transports the sheet S between the stapler 62 and the discharge section 23.

The post-processing control section 24 of the sheet post-processing device 3 controls the transport speed of the sheet S by controlling a rotational speed of the outlet rollers 33*a* and 33*b* when discharging the sheet S to the processing tray 61. Hereinafter, the control of the transport speed of the sheet S in the post-processing control section 24 in the first embodiment will be described. Moreover, as a premise of performing the control of the transport speed of the sheet S in the first embodiment, the sheet S is assumed to be in a state of being directly discharged to the processing tray 61 without passing through the standby tray 41.

FIG. 4 is a block diagram illustrating functional blocks related to the control of the transport speed of the sheet S in the post-processing control section 24. As illustrated in FIG. 4, the post-processing control section 24 includes a communication section 241, a sheet information acquisition section 242, a sensor information acquisition section 243, and a rotation control section 244.

The communication section 241 performs communication with the control panel 11 of the image forming device 2. The sheet information acquisition section 242 acquires information related to a type of post-processing input from the control panel 11 via the communication section 241 and information related to a type of the sheet S on which post-processing is performed. The information related to the type of the sheet S includes information (information of A4, A3, and the like) related to the size of the sheet S, information related to a basis weight of the sheet S, information related to a material of the sheet S, and the like. The basis weight of the sheet S is a weight of the sheet S per square meter ($g/m^2$).

The sensor information acquisition section 243 acquires a detection signal according to the detection of the sheet S passing through the sheet discharge port 31*d* from the outlet sensor 36. In the following description, the detection signal of the high level indicating detection of the sheet S is referred to as an ON signal and the detection signal of the low level indicating no detection of the sheet S is referred to as an OFF signal. The rotation control section 244 sets the first speed and the second speed that are the transport speeds of the sheet S based on the information related to the sheet S that is the transport object acquired by the sheet information acquisition section 242. The rotation control section 244 controls the transport speed of the sheet S based on the detection signal and the information related to the sheet S acquired by the sensor information acquisition section 243.

The rotation control section 244 controls the rotational speed of a driving motor rotating the outlet rollers 33*a* and 33*b* by a pulse speed (pps: pulses per second). That is, the rotation control section 244 controls the transport speed of the sheet S by controlling the rotational speed of the outlet rollers 33*a* and 33*b*. The rotation control section 244 sets the first speed to a v1 (pps) and sets the second speed of the sheet S to a v2 (pps), for example, based on the information related to the sheet S. The first speed=v1 (pps) and the second speed S=v2 (pps) of the sheet are an example and the rotation control section 244 can set arbitrary values according to the size and the basis weight of the sheet S.

The transport speeds of the sheet S are the first speed that is a speed for transporting the sheet S in the transport path 31 and the second speed (first speed>second speed) that is a speed suitable for discharging the sheet S to the processing tray 61. The speed suitable for discharging the sheet S to the processing tray 61 is a speed at which the discharged sheet S lands on a predetermined position of the processing tray 61. That is, the post-processing control section 24 controls the sheet S so that the sheet S is transported in the transport path at the first speed or the second speed. The rotation control section 244 decelerates the transport speed before the leading end portion of the sheet S colliding with the processing tray 61 based on timing when the detection signal becomes the ON signal and the size of the sheet S. The timing when the detection signal becomes the ON signal is timing when the leading end portion of the sheet S passes through the sheet discharge port 31*d*. Before the leading end portion of the sheet S collides with the processing tray 61 refers to a period after the leading end portion of the sheet S passes through the sheet discharge port 31*d* and before the sheet S comes into contact with the processing tray 61.

It is possible to predict that the leading end portion of the sheet S collides with the processing tray 61 when the leading end portion of the sheet S is transported how much from the sheet discharge port 31*d* based on the size and the basis weight of the sheet S, the distance from the sheet discharge port 31*d* to the processing tray 61, and the like. Here, a transport amount from the sheet discharge port 31*d* to immediately before the leading end portion of the sheet S colliding with the processing tray 61 is a first transport amount. The rotation control section 244 monitors the transport amount of the sheet S from a time point when the leading end portion of the sheet S passes through the sheet discharge port 31*d* and performs deceleration at a time point when the sheet S is transported by the first transport amount. The rotation control section 244 also sets the first transport amount based on the information related to the sheet S when setting the first speed and the second speed.

Next, a control operation of the transport speed of the sheet S in the post-processing control section 24 of the sheet post-processing device 3 will be described. FIG. 5 is a flowchart illustrating a control operation example of the transport speed of the sheet S in the post-processing control section 24 of the sheet post-processing device 3.

The sheet information acquisition section 242 acquires the information related to the type of post-processing and the information related to the type of the sheet S to which post-processing is performed (ACT11). The rotation control section 244 sets the first speed and the second speed that are the transport speeds of the sheet S, and the first transport amount based on the information related to the sheet S that is the transport object acquired by the sheet information' acquisition section 242 (ACT12). The sheet post-processing device 3 transports the sheet S at the first speed if the sheet S is supplied to the sheet supply port 31*p* (ACT13). Specifically, the post-processing control section 24 controls the rotational speed of the inlet rollers 32*a* and 32*b*, and the outlet rollers 33*a* and 33*b* and thereby the sheet S is transported at the first speed (=v1 (pps)).

The rotation control section 244 determines whether or not the ON signal is acquired from the outlet sensor 36 by the sensor information acquisition section 243 (ACT14). Here, if it is determined that the ON signal is not acquired (NO of ACT14), the rotation control section 244 performs the process of ACT14 again. If it is determined that the ON signal is acquired (YES of ACT14), the rotation control section 244 determines whether or not the sheet S is transported by the first transport amount after the sheet S passes through the sheet discharge port 31*d* (ACT15).

If it is determined that the sheet S is not transported by the first transport amount (NO of ACT15), the rotation control section 244 performs the process of ACT15 again. If it is determined that the sheet S is transported by the first transport amount (YES of ACT15), the rotation control section 244 decelerates the transport speed of the sheet S from the first speed to the second speed (=v2 (pps)) (ACT16). Therefore, the speed when the sheet S collides with the processing tray 61 is reduced and it is possible to prevent generation of buckling of the sheet S due to the collision.

The rotation control section 244 determines whether or not the sensor information acquisition section 243 acquires the OFF signal from the outlet sensor 36 (ACT17). Here, if it is determined that the OFF signal is not acquired (NO of ACT17), the rotation control section 244 performs the process of ACT17 again. If it is determined that the OFF signal is acquired (YES of ACT17), the rotation control section 244 stops the driving motor of the outlet rollers 33*a* and 33*b* (ACT18).

The control operation of the transport speed of the sheet S in the post-processing control section 24 described above is described compared to a control operation in the related art. FIG. 6 is a diagram comparing the control operation of the transport speed of the sheet S in the post-processing control section 24 to the control operation in the related art.

The sheet post-processing device of the related art decelerates the speed of the sheet from a first transport speed (corresponding to the first speed in the first embodiment) to a second transport speed (corresponding to the second speed in the first embodiment) at a time t3 elapsed a period T1 after the ON signal of the outlet sensor is detected at a time t1. The time t3 is timing before (before the trailing end portion of the sheet passes through a sheet discharge port) the outlet sensor outputs the OFF signal. Even if the sheet is decelerated in the timing, the sheet may be buckled due to the following reasons.

If the leading end portion of the sheet from the sheet discharge port comes into contact with the processing tray, the transport of the sheet is obstructed by friction between the sheet and the processing tray. That is, the transport speed of the leading end portion of the sheet is decreased due to the friction with the processing tray. In this state, if the sheet is transported at a high speed (first transport speed), a speed difference of the transport speeds of the leading end portion of the sheet and the trailing end portion thereof is increased. Therefore, buckling is likely to occur in the sheet.

On the other hand, the sheet post-processing device 3 in the first embodiment decelerates the speed of the sheet from the first speed to the second speed at a time t2 elapsed a period T2 after the ON signal of the outlet sensor is detected at the time t1. The time t2 is timing elapsed the period T2 that is a time required to transport the sheet S from the time t1 by the first transport amount described above. Moreover, control in which the outlet sensor issues the OFF signal at the time t4, and the driving motor rotating the outlet rollers 33*a* and 33*b* is stopped at the time t5 is the same as that of the related art.

As described above, the sheet post-processing device of the related art completes the deceleration from the first transport speed to the second transport speed in the vicinity of the exit of the trailing end of the sheet from the outlet rollers after the leading end portion of the sheet comes into contact with the processing tray. Therefore, the sheet collides with the processing tray at the first transport speed that is a high speed and thereafter, a behavior of the sheet transported at the first transport speed until exiting the outlet rollers is not stable due to buckling and the like. On the other hand, the sheet post-processing device 3 of the first embodiment completes the deceleration of the transport speed of the sheet S discharged to the processing tray 61 from the first speed to the second speed before the leading end portion of the sheet S comes into contact with the processing tray 61. Therefore, the sheet post-processing device 3 can suppress the occurrence of the buckling of the sheet S when coming into contact with the processing tray 61. If the occurrence of the buckling of the sheet S is suppressed, thereafter, aligning and the like in the paddle section 34 are stable and accuracy of vertical alignment of the sheets S is improved.

Modification Example of First Embodiment

The post-processing control section 24 of the sheet post-processing device 3 may control the transport speed of the sheet S in a multistage manner. Hereinafter, as a modification example of the first embodiment, the control of the transport speed of the sheet S in the multistate in a post-processing control section 24 will be described. A rotation control section 244 sets a third speed in addition to the first speed and the second speed based on information related to the sheet S. The third speed is a value (first speed>third speed>second speed) that is less than the first speed and greater than the second speed. The third speed is preferably the fastest speed in a range in which the sheet S is not buckled when the sheet S comes into contact with a processing tray 61 and is, for example, v3 (pps).

The rotation control section 244 performs deceleration to the third speed at a time point when the sheet S is transported by the first transport amount after the leading end portion of the sheet S passes through the sheet discharge port 31*d*.

Here, a transport amount until immediately before the trailing end portion of the sheet S passes through the sheet discharge port 31*d* is referred to as a second transport amount. The rotation control section 244 performs the deceleration from the third speed to the second speed at a time point when the sheet S is transported by the second transport amount after the leading end portion of the sheet S passes through the sheet discharge port 31*d*. The rotation control section 244 also sets the first transport amount and the second transport amount based on information related to the sheet S when setting the first speed, the second speed, and the third speed.

Next, a control operation of the transport speed of the sheet S in the post-processing control section 24 of the sheet post-processing device 3 will be described. FIG. 7 is a flowchart illustrating an operation example for controlling the transport speed of the sheet S in the multistage manner in the post-processing control section 24 of the sheet post-processing device 3. Moreover, in FIG. 7, the same reference numerals are given to the same processes in FIG. 6 and the description will be simplified or omitted.

Following the process of ACT11 to ACT14, the rotation control section 244 determines whether or not the sheet S is transported by the first transport amount after the sheet S passes through the sheet discharge port 31*d* (ACT15). If it is determined that the sheet S is not transported by the first transport amount (NO of ACT15), the rotation control section 244 performs the process of ACT15 again.

If it is determined that the sheet S is transported by the first transport amount (YES of ACT15), the rotation control section 244 decelerates the transport speed of the sheet S from the first speed to the third speed (=v3 (pps)) (ACT71). Therefore, the speed of the sheet S is reduced when colliding with the processing tray 61 and it is possible to prevent the occurrence of the buckling of the sheet S due to the collision.

The rotation control section 244 determines whether or not the sheet S is transported by the second transport amount after the sheet S passes through the sheet discharge port 31*d* (ACT72). If it is determined that the sheet S is not transported by the second transport amount (NO of ACT72), the rotation control section 244 performs the process of ACT72 again.

If it is determined that the sheet S is transported by the second transport amount (YES of ACT72), the rotation control section 244 decelerates the transport speed of the sheet S from the third speed to the second speed (=v2 (pps)) (ACT73). Since the following processes ACT17 and ACT18 are the same as the processes illustrated in FIG. 5, the description will be omitted.

Next, change timing of the transport speed of the sheet S in the multistage manner will be described based on a timing chart. FIG. 8 is a diagram describing the control operation of the transport speed of the sheet S in the multistage manner in the post-processing control section 24.

The sheet post-processing device 3 in modification example of the first embodiment decelerates the speed of the sheet from the first speed to the third speed at the time t2 elapsed the period T2 after the ON signal of the outlet sensor is detected at the time t1. The time t2 is timing elapsed the period T2 that is a time required to transport the sheet S from the time t1 by the first transport amount described above.

The sheet post-processing device 3 decelerates the speed of the sheet S from the third speed to the second speed at a time t6 elapsed a period T3 from the time t1. The time t6 is timing elapsed the period T3 that is a time required to transport the sheet S from the time t1 by the second transport amount. Moreover, the control in which the outlet sensor issues the OFF signal in the time t4 and the driving motor rotating the outlet rollers 33*a* and 33*b* is stopped at the time t5 is the same as that of FIG. 6.

The sheet post-processing device 3 that is a modification example of the first embodiment can shorten a time until the discharge of the sheet S is completed in addition to the advantages described above in the first embodiment.

Second Embodiment

The sheet post-processing device 3 of the first embodiment described above is configured to control the transport speed of the sheet S when the sheet S is directly discharged to the processing tray 61 without passing through the standby tray 41. A sheet post-processing device 3 of a second embodiment controls the transport of the sheet S when the sheet S is directly discharged to the standby tray 41 in addition to the function of the sheet post-processing device 3 of the first embodiment.

For example, if five sheets S are processed in a staple mode, after initial three sheets S are once held in the standby tray 41, the sheet post-processing device 3 drops the sheets S on the processing tray 61. Thereafter, the sheet post-processing device 3 directly discharges fourth and fifth sheets S to the processing tray 61. In such an operation mode, the sheet post-processing device 3 of the second embodiment performs transporting of the fourth and fifth sheets S by the control described in the first embodiment. Then, the sheet post-processing device 3 of the second embodiment performs transporting of the initial three sheets S by control described in the second embodiment that is described below.

Moreover, an entire configuration of an image forming system 1 including the sheet post-processing device 3 of the second embodiment is the same as the configuration of FIG. 1. A functional configuration of the image forming system 1 including the sheet post-processing device 3 of the second embodiment is the same as the configuration of FIG. 2.

FIG. 9 is a view schematically describing a configuration of the sheet post-processing device 3 in the second embodiment. Moreover, in FIG. 9, the same references are given to the same configuration elements as FIG. 3 and the description will be simplified or omitted. The sheet post-processing device 3 illustrated in FIG. 9 is different from the sheet post-processing device 3 illustrated in FIG. 3 that a corrugation cam 37 is further included. The corrugation cam 37 is a cam that presses, for example, a center of the sheet S in a width W direction transported along the transport guide 43. The corrugation cam 37 causes a shape of a pressed portion of the sheet S to be a recessed arc shape by pressing the sheet S and imparts rigidity with respect to the sheet S. Therefore, the rigidity of the sheet S is increased in a direction parallel to the transporting direction D.

The corrugation cam 37 illustrated in FIG. 9 has a fan-shaped form and rotates around the pivot of the fan shape as illustrated in FIG. 10. The corrugation cam 37 illustrated in FIG. 9 is retreated above from the transport guide 43 and is not functioning. FIG. 10 is a view illustrating a state in which the corrugation cam 37 is functioning. Moreover, since each reference numeral in FIG. 10 is the same as that of FIG. 9, the description will be omitted.

As illustrated in FIG. 10, the corrugation cam 37 protrudes below the transport guide 43 by rotating in the counterclockwise direction. Therefore, a protruded portion of the corrugation cam 37 presses, for example, substantially the center of the width of the sheet S transported along the transport guide 43.

FIG. 11 is a block diagram illustrating functional blocks related to the control of the transport of the sheet S discharged to a standby tray 41 in the post-processing control section 24. In FIG. 11, the same numerals are given to the configurations having the same function as FIG. 4 and the description will be omitted.

As illustrated in FIG. 11, the post-processing control section 24 includes a communication section 241, a sheet information acquisition section 242, a sensor information acquisition section 243, a rotation control section 244*a*, and a posture control section 245. The rotation control section 244*a* controls the transport of the sheet S discharged to the standby tray 41 in addition to the function of the rotation control section 244 illustrated in FIG. 3. The posture control section 245 determines whether or not the corrugation cam 37 is functioning and controls the corrugation cam 37 based on information related to the sheet S of the transport object acquired by the sheet information acquisition section 242. The corrugation cam 37 is in a state of functioning illustrated in FIG. 10 or a state of not functioning illustrated in FIG. 9 depending on the control from the posture control section 245. The posture control section 245 causes the corrugation cam 37 to function if the sheet S of the transport object is equal to or greater than a predetermined size and causes the corrugation cam 37 to do not function if the sheet S of the transport object is less than the predetermined size. Rigidity of paper having a large size becomes low as a distance transported from the outlet rollers 33*a* and 33*b* is increased when the paper remains flat. However, if the shape of the sheet S is curved in the arc shape by the corrugation cam 37, the rigidity is increased and it is possible to hold the rigidity of the sheet S even if the distance existing from the outlet rollers 33*a* and 33*b* is increased.

The rotation control section 244*a* can predict whether the leading end portion of the sheet S reaches the discharge rollers 44*a* and 44*b* when the leading end portion of the sheet S is transported how much from the sheet discharge port 31*d* based on the size and the basis weight of the sheet S, distance from the sheet discharge port 31*d* to the discharge rollers 44*a* and 44*b*, and the like. Here, a transport amount until the leading end portion of the sheet S smaller than the predetermined size reaches the discharge rollers 44*a* and 44*b* from the sheet discharge port 31*d* is referred to as a third transport amount. Here, a transport amount until the leading end portion of the sheet S equal to or greater than the predetermined size reaches the discharge rollers 44*a* and 44*b* from the sheet discharge port 31*d* is referred to as a fourth transport amount. The rigidity of the sheet S equal to or greater than the predetermined size is imparted by the corrugation cam 37. Thus, the sheet S reaches the discharge rollers 44*a* and 44*b* in a transport path closer to a straight line. Therefore, a relationship of the third transport amount>the fourth transport amount is satisfied.

That is, the rotation control section 244*a* performs transport of the sheet S smaller than the predetermined size by the third transport amount after the trailing end portion of the sheet S exits the sheet discharge port 31*d*. The rotation control section 244*a* performs transport of the sheet S equal to or greater than the predetermined size by the fourth transport amount after the trailing end portion of the sheet S exits the sheet discharge port 31*d*. The rotation control section 244*a* can stabilize the positions (buffer positions) of the plurality of sheets S held in the standby tray 41 by changing the transport amount with the size of the sheet S as described above.

The rotation control section 244*a* monitors the transport amount of the sheet S after a time point when the trailing end portion of the sheet S passes through the sheet discharge port 31*d* and transports the sheet S by the third transport amount or the fourth transport amount depending on the size of the sheet S.

FIG. 12 is a flowchart illustrating an operation example of control of a transport amount of the sheet S on the standby tray 41 in the post-processing control section 24 of the second embodiment.

The sheet information acquisition section 242 acquires information related to the type of post-processing and information related to the type of the sheet S to which post-processing is performed (ACT21). The rotation control section 244*a* sets the third transport amount or the fourth transport amount as the transport amount of the sheet S based on information related to the sheet S of the transport object acquired by the sheet information acquisition section 242 (ACT22). The sheet post-processing device 3 transports the sheet S to the standby tray 41 at the first speed if the sheet S is supplied to the sheet supply port 31*p* (ACT23).

The rotation control section 244*a* determines whether or not the sensor information acquisition section 243 acquires the OFF signal from the outlet sensor 36 (ACT24). If it is determined that the OFF signal is not acquired (NO of ACT24), the rotation control section 244*a* performs the process of ACT24 again. If it is determined that the OFF signal is acquired (YES of ACT24), the rotation control section 244*a* determines whether or not the size of the sheet S is equal to or greater than the predetermined size (ACT25). Here, if it is determined that the size of the sheet S is less than the predetermined size (NO of ACT25), the rotation control section 244*a* transports the sheet S with the third transport amount (ACT27). If it is determined that the size of the sheet S is equal to or greater than the predetermined size (YES of ACT25), the rotation control section 244*a* transports the sheet S with the fourth transport amount (ACT26). The rotation control section 244*a* completes the transport process with respect to the sheet S if the process of ACT26 or ACT27 is completed.

Next, a change of the transport amount of the sheet S will be described based on a timing chart. FIG. 13 is a timing chart describing a control operation the transport amount of the sheet S in the post-processing control section 24 of the second embodiment. In FIG. 13, a timing chart in an upper portion is a timing chart in a case in which the size of the sheet S is less than the predetermined size. A timing chart in a lower portion is a timing chart in a case in which the size of the sheet S is equal to or greater than the predetermined size.

First, the timing chart in the upper portion will be described. The rotation control section 244*a* in the second embodiment stops the transport of the sheet S at a time t13 elapsed a period T4 after the OFF signal of the outlet sensor is detected at a time t11. The time t13 is timing elapsed the period T4 that is a time required to transport the sheet S from the time t11 by the third transport amount described above.

Next, the timing chart in the lower portion will be described. The rotation control section 244*a* in the second embodiment stops the transport of the sheet S at a time t12 elapsed a period T5 after the OFF signal of the outlet sensor is detected at a time t11. The time t12 is timing elapsed the period T5 that is a time required to transport the sheet S from the time t11 by the fourth transport amount described above.

As is apparent by comparing the period T4 and the period T5 described above, in the rotation control section 244*a*, the transport amount to be transported is shorter in a case in which the size of the sheet S is equal to or greater than the predetermined size than in a case in which the size of the sheet S is less than the predetermined size. That is, in the rotation control section 244*a*, the transport amount to be transported is shortened in the case in which the size of the sheet S is equal to or greater than the predetermined size compared to the case in which the size of the sheet S is less than the predetermined size. The rotation control section 244*a* in the second embodiment can suppress variation of the rear end position of the sheet S and stabilize the rear end position of the sheet S due to a difference in the transport path for each size of the sheet S by causing the transport amount of the sheet S to be adjusted on the standby tray 41. Therefore, the sheet post-processing device 3 in the second embodiment can stabilize the buffer position by the standby tray 41 and then can also stabilize drop of the sheet onto the processing tray 61.

According to at least one embodiment described above, the sheet post-processing device 3 can suppress occurrence of the buckling of the sheet S when coming into contact with the processing tray 61.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet post-processing device comprising:

a first tray that holds a sheet for post-processing with respect to the sheets supplied from an image forming device;

outlet rollers that discharge the sheets to the first tray;

an outlet sensor that detects the sheets passing through the outlet rollers in the vicinity of the outlet rollers;

a sheet information acquisition section that acquires information related to the sheet from the image forming device;

a control section that sets, based on the acquired information, a first speed, a second speed, and a transport amount;

wherein the control section further controls a rotational speed of the outlet rollers, the rotational speed is set to the first speed in response to the sheet being supplied from the image forming device, the rotational speed is decelerated to the second speed in response to a detection of the sheet by the outlet sensor in addition to a determination that the sheet is transported the transport amount, and the deceleration is completed before a leading end of the sheet comes into contact with the first tray.

2. The device according to claim 1, wherein, the control section decelerates the transport speed of the sheet before the sheet comes into contact with the first tray from the first speed to a third speed that is an intermediate transport speed of the first speed and the second speed, and decelerates the transport speed of the sheet from the third speed to the second speed before a trailing end portion of the sheet passes through the outlet rollers.

3. The device according to claim 1, further comprising:

a second tray that temporarily holds the sheets before the sheets are transported to the first tray, wherein, the control section changes the transport amount after a trailing end portion of the sheet passes through the outlet rollers depending on whether or not a size of the sheet is equal to or greater than a predetermined size.

* * * * *